United States Patent [19]

Sakashita et al.

[11] Patent Number: 4,645,437

[45] Date of Patent: Feb. 24, 1987

[54] SCROLL COMPRESSORS WITH ANNULAR SEALED HIGH PRESSURE THRUST PRODUCING MEMBER

[75] Inventors: Wataru Sakashita; Tsukasa Chiyoya, both of Fuji; Tsutomu Ichikawa, Fujinomiya; Makoto Hayano, Tokyo, all of Japan

[73] Assignee: Kabushiki Kaisha Toshiba, Kawasaki, Japan

[21] Appl. No.: 749,449

[22] Filed: Jun. 27, 1985

[30] Foreign Application Priority Data

Jun. 27, 1984 [JP] Japan ..... 59-131197
Sep. 27, 1984 [JP] Japan ..... 59-200675

[51] Int. Cl.[4] ..... F04C 18/04; F04C 27/00; F16J 9/08; F16J 15/34

[52] U.S. Cl. ..... 418/55; 418/57; 277/81 R; 277/173; 277/217

[58] Field of Search ..... 418/55, 57, 132; 277/81 R, 81 P, 82, 173, 174, 216, 217

[56] References Cited

U.S. PATENT DOCUMENTS 1,075,590 10/1913 Moors ..... 418/57
3,139,233 6/1964 Simonsen ..... 277/81 P
3,600,114 8/1971 Dvorak et al. ..... 418/57
3,994,633 11/1976 Shaffer ..... 418/57
4,243,233 1/1981 Arai ..... 277/81 P

FOREIGN PATENT DOCUMENTS 57-23793 5/1982 Japan .
57-49721 10/1982 Japan .

*Primary Examiner*—John J. Vrablik
*Attorney, Agent, or Firm*—Schwartz, Jeffery, Schwaab, Mack, Blumenthal & Evans

[57] ABSTRACT

In a scroll compressor enclosed in a casing and a movable scroll member is driven eccentrically by an electric motor, a thrust force created by the compression and applied to the movable scroll member is cancelled by a high pressure chamber which is provided between a surface of the movable scroll member and a frame member and supplied with a pressurized gas delivered from the scroll compressor. The high pressure chamber is formed into an annular shape defined by radially inner and outer tapered walls, and radially inner and outer seal rings having resilience to shrink and expand respectively are provided in the chamber for preventing leakage of the gas out of the high pressure chamber.

8 Claims, 17 Drawing Figures

SCROLL COMPRESSORS WITH ANNULAR SEALED HIGH PRESSURE THRUST PRODUCING MEMBER

BACKGROUND OF THE INVENTION

This invention relates to a scroll compressor, and more particularly to a type thereof wherein sealing of a high pressure chamber formed between the movable scroll member and the frame can be substantially improved.

Recently, scroll compressors have been frequently used in refrigerators and the like. Referring to FIGS. 1 to 5, the scroll compressor comprises a stationary scroll member 1 and a movable scroll member 2 respectively having spiral wraps 1*a* and 2*a* of involute or the like configuration. The stationary scroll member 1 and the movable scroll member 2 are engaged with each other with a predetermined angle (180°) maintained therebetween, so that a compressing space 3 of a crescent shape is formed between the wraps 1*a* and 2*a*. When the movable scroll member 2 is driven to move orbitally around the center $O_1$ of the stationary scroll member 1 while maintaining a predetermined eccentric distance e, the compressing space 3 is moved toward the center of the spiroid spiral with the volume of the space 3 being reduced. As a consequence, the fluid in the compressing space 3 is continuously compressed and delivered from a central port (not shown) of the compressor.

FIGS. 3 and 4 illustrate a construction of a compressing element 4 of the scroll compressor, which has been disclosed in our copending U.S. patent application Ser. No. 655,429 (filed: Sept. 28, 1984). In the construction, the peripheral portion 5 of the stationary scroll member 1 is secured to a frame 6 by means of bolts 7 and the like, while the movable scroll member 2 engaging with the stationary scroll member 1 is encased in the frame 6 to be freely revolvable. The movable scroll member 2 has a rear side, which is opposite to the front side provided with the wrap 2*a*, supported by the frame 6 through a high-pressure receiving annular member 9.

The high-pressure receiving annular member 9 is mounted, as shown in FIG. 4, on a mounting surface 10 of the frame 6, and on the upper surface 11 of the member 9 is provided a high pressure chamber 12 for counter-balancing a thrust caused in the compressing element 4. A fluid passage 14 is formed through a planar portion 13 of the movable scroll member 2 for introducing the fluid extracted from the compressing space 3, or from the last stage of the compression, into the high pressure chamber 12. A bearing portion 15 is formed on the rear surface 8 of the movable scroll member 2 to be coupled with an eccentric shaft portion 17 of a crank shaft 16 rotatably supported by the frame 6. As a consequence, when the crank shaft 16 is rotated, the movable scroll member 2 is revolved around the center of the wrap 1*a* of the stationary scroll member 1. For preventing the rotation of the movable scroll member 2 around its own axis at this time, an Oldham ring 18 is provided between the movable scroll member 2 and the frame 6.

In the above described conventional construction of the compressing element 4, however, the sealing property of the sliding portion provided between the high-pressure receiving annular member 9 and the movable scroll member 2 has been comparatively low, and a relatively large amount of the pressurized fluid may be leaked out of the high pressure chamber 12. That is, when the pressurized fluid of a pressure Pd is supplied through the fluid passage 14 into the high-pressure chamber 12, a force Pm pushing the movable scroll member 2 upward is created in the chamber 12, thereby providing a gap S of a distance $\Delta l_1$ between the high-pressure receiving annular member 9 and the rear-side surface 8 of the movable scroll member 2. Because of the provision of the gap S, the pressure of the fluid in the chamber 12 is reduced, thus making it difficult to provide a sufficient strength of force counter-acting against the thrust applied to the movable scroll member 2. Furthermore, since the leaked fluid has been extracted from the compressing space 3 or from the last stage of the compression, leakage of the same reduces the compression efficiency of the compression element 4.

SUMMARY OF THE INVENTION

An object of the present invention is to provide an improved scroll compressor wherein the above described difficulties of the conventional construction can be substantially eliminated.

Another object of the invention is to provide a scroll compressor wherein sealing rings of a special design are provided in the high pressure chamber for improving the sealing property of the high pressure chamber.

According to the invention, there is provided a scroll compressor of a type comprising a casing, a frame provided in the casing, an electric motor and a compressor assembly mounted on opposite sides of the frame, the compressor assembly comprising a stationary scroll member and a movable scroll member respectively having spiral wraps engaging with each other so that the movable scroll member is driven by the electric motor eccentrically around the center of spiroid spiral of the stationary scroll member, the movable scroll member having a planar portion on a side thereof facing the frame, the stationary scroll member having a peripheral portion secured to the frame, an annular member having radially outer and inner walls and a bottom wall for defining an annular high pressure chamber therebetween, and passage means provided for supplying a part of a compressible fluid delivered from the compressor assembly into the high pressure chamber for reducing a thrust force applied to the movable scroll member, wherein the outer and inner walls of the annular member are provided with internal surfaces tapered radially outwardly and inwardly from the bottom wall of the annular member, respectively, and radially outer and inner seal rings made of a resilient material and each having a tapered surface are provided in the high pressure chamber such that the seal rings are slidable relative to the walls of the annular member with the tapered surfaces of the rings contacting with the tapered internal surfaces of the radially outer and inner walls of the annular member.

According to a preferred embodiment of the invention, each of the seal rings is provided with a separate portion, in which two separate ends of the ring are slidable with each other along a circumferential plane which is selected to pass through an intermediate portion of the radial thickness of the seal ring.

DESCRIPTION OF THE PREFERRED EMBODIMENTS

Before entering the description of this invention, a general construction of a conventional scroll compressor will now be described in detail with reference to FIG. 5.

Figure 1:
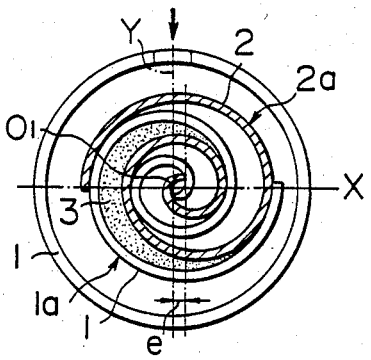
FIG. 1 PRIOR ART
FIGS. 1 and 2 are diagrams showing different engaging conditions between a stationary scroll wrap and a movable scroll wrap.
Figure 2:
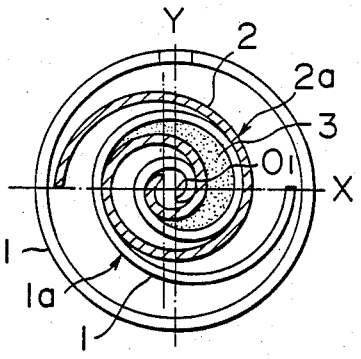
FIG. 2 PRIOR ART
Figure 3:
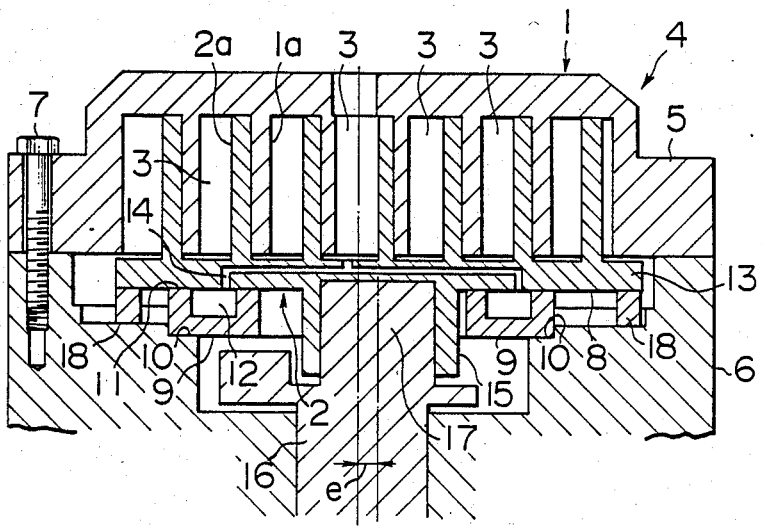
FIG. 3 is a longitudinal sectional view of a compressor portion of a conventional scroll compressor.
Figure 4:
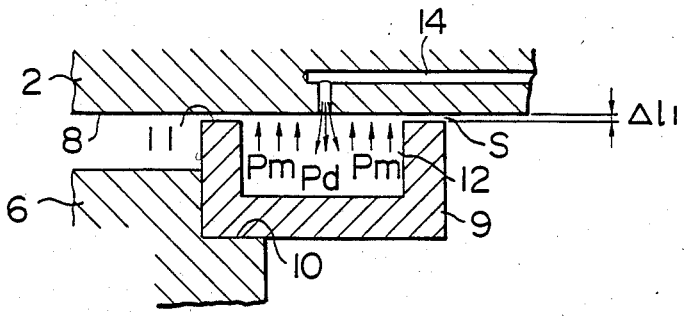
FIG. 4 is an enlarged sectional view showing one part of FIG. 3.
Figure 5:
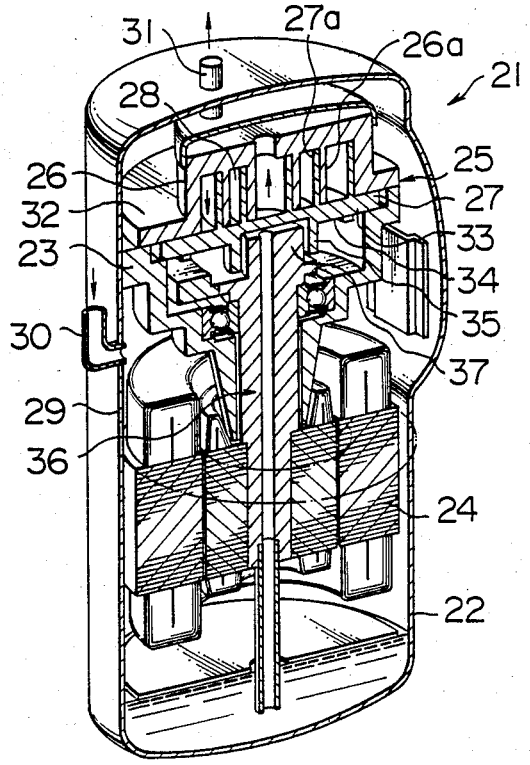
FIG. 5 PRIOR ART
FIG. 5 is a fragmented perspective view showing a general construction of a conventional scroll compressor.

As shown in FIG. 5, the scroll compressor 21 comprises a casing 22, a frame 23 internally secured to the casing 22, an electric motor 24 provided below the frame 23, and a compressor assembly 25 provided above the frame 23. The compressor assembly 25 comprises a stationary scroll member 26 and a movable scroll member 27 provided with spiral wraps 26*a* and 27*a* which extend downwardly and upwardly from the two members 26 and 27, respectively. The spiral wraps 26*a* and 27*a* are formed into a similar configuration of, for instance, involute or the like, and are meshed with each other so that a closed compressing space 28 of a crescent shape is formed between the two wraps 26*a* and 27*a*. Through a side wall 29 of the casing 22, a supplying pipe 30 of a gas to be compressed is extended outwardly, while a delivering pipe 31 for delivering the compressed gas is extended through the top wall of the casing 22.

The stationary scroll member 26 provided in the casing 22 with the wrap 26*a* disposed downwardly is secured at the circumferential portion 32 thereof to the frame 23 by means of bolts and the like (not shown). The movable scroll member 27 with the wrap portion 27*a* thereof disposed upwardly is received rotatably in an upper part of the frame 23. A bearing portion 35 is formed to project downwardly from the lower surface 34 of a planar portion 33 of the movable scroll member 27. The bearing portion 35 engages with an eccentric shaft portion 37 of a crank shaft 36 extending vertically upward and supported rotatably by the frame 23. That is, the movable scroll member 27 is driven by the crank shaft 36 so that the center of the member 27 revolves around the center of the stationary scroll member 26 with a predetermined radius of eccentricity maintained therebetween. When the movable scroll member 27 thus revolves around the stationary scroll member 26 in one direction, the crescent-shaped compressing space 28 formed between the two wraps 26*a* and 27*a* is shifted along the wraps toward the center of the stationary scroll member 26, while the size of the compressing space 28 is constantly reduced.

The invention will now be described with reference to FIGS. 6 through 17.

Figure 6:
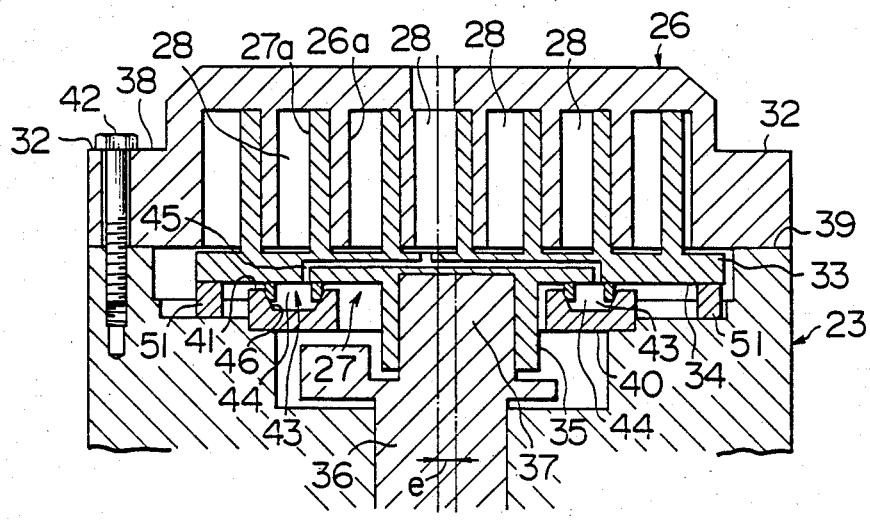
FIG. 6 is a longitudinal sectional view showing a compressor portion of a scroll compressor constituting a preferred embodiment of this invention.

In an embodiment shown in FIG. 6, the peripheral portion 32 of the stationary scroll member 26 is formed into a flange shape, and is secured to an upper surface 39 of the frame 23 by means of bolts 42. On the other hand, a high-pressure receiving annular member 40 is provided between the lower surface 34 of the planar portion 33 of the movable scroll member 27 and the frame 23, so that the movable scroll member 27 is supported by the annular member 40.

Figure 7:
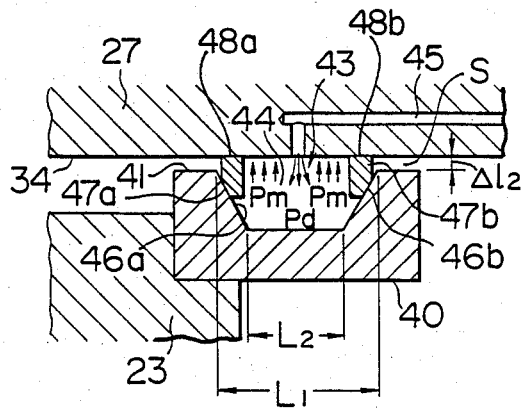
FIG. 7 is an enlarged sectional view showing one part of FIG. 6.

More specifically, when the gas is compressed in the compressing space 28 formed between the two wraps 26*a* and 27*a*, a downward thrust is applied to the movable scroll member 27. For the purpose of cancelling this thrust, a high pressure chamber 43 is formed on the upper surface 41 of the annular member 40. The high pressure chamber 43 is provided in the form of an annular groove 44. Surfaces 46*a* and 46*b* defining radially outer and inner sides of the groove 44 are respectively tapered upwardly and outwardly, and upwardly and inwardly, so that the radial distance between the two surfaces 46*a* and 46*b* increases upwardly from $L_2$ to $L_1$ as shown in FIG. 7. A passage 45 is formed through the planar portion 33 of the movable scroll member 27. One end of the passage 45 is connected to the compressing space 28 or a delivery portion of the compressor unit 25 and the other end of the passage 45 is opened to the high pressure chamber 43 formed in the annular groove 44 of the annular member 40. An Oldham ring 51 is provided below the planar portion 33 of the movable scroll member 27, for preventing the movable scroll member 27 from being rotated around its central axis.

In the high pressure chamber 43 formed in the annular member 40 are located an outer seal ring 47*a* and an inner seal ring 47*b* for improving the sealing effect of the high pressure chamber 43. The seal rings 47*a* and 47*b* are provided with tapered surfaces conforming with the tapered surfaces 46*a* and 46*b* defining radially outer and inner sides of the groove 44, i.e. the chamber 43, so that the seal rings 47*a* and 47*b* are slidingly contactable with the tapered surfaces 46*a* and 46*b*.

Figure 8:
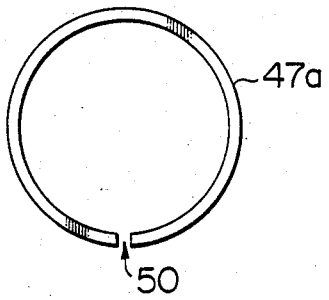
FIG. 8 is a plan view showing a resilient ring used for this invention.

Each of the seal rings 47*a* and 47*b* is preferably provided with a cutaway or separated portion 50 as shown in FIG. 8 so as to permit a required amount of expansion or shrinkage. Furthermore, the seal rings are made of a resilient material so processed that the outer ring 47*a* tends to expand while the inner ring 47*b* tends to shrink. As a consequence, when the sealing rings are placed in the high pressure chamber 43, the rings move upward or downward according to a gap S formed between the upper surface of the annular member 40 and the lower surface 34 of the movable scroll member 27 along the tapered surfaces 46*a* and 46*b* of the high pressure chamber 43, so that the gap S is sealed by respective sealing surfaces 48*a* and 48*b* of the seal rings 47*a* and 47*b*.

Figure 9:
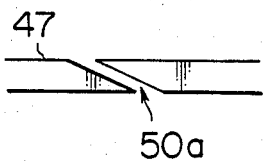
FIGS. 9, 10 and 11 are diagrams showing various types of a separate portion of the resilient ring.
Figure 10:
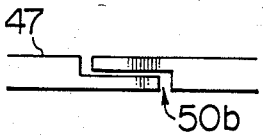
Figure 12:
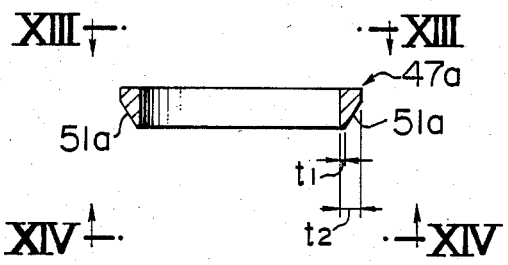
FIG. 12 is a longitudinal sectional view of a resilient ring of an improved construction according to this invention.
Figure 11:
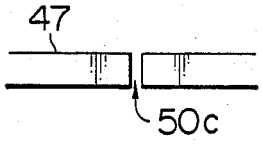
Figure 13:
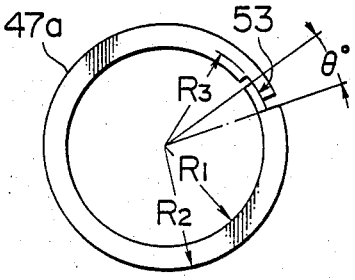
FIGS. 13 and 14 are plan views taken from upper and lower positions in FIG. 12.
Figure 14:
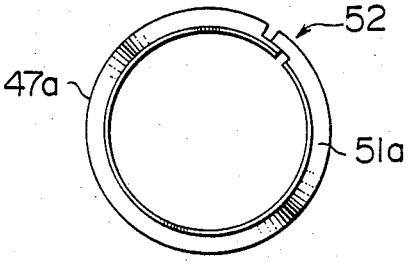
Figure 15:
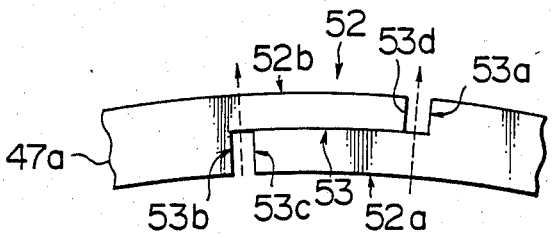
FIGS. 15 and 16 are enlarged views of a separate portion shown in FIGS. 13 and 14, respectively.
Figure 16:
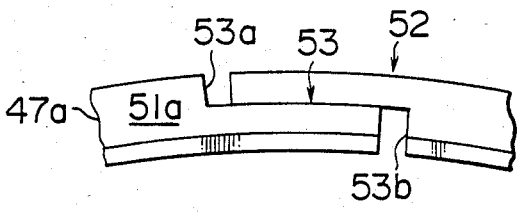

FIGS. 9, 10 and 11 illustrate various examples of the separated portion 50 formed in each of the seal rings 47*a* and 47*b*, among which FIG. 9 illustrates a separated portion 50 formed obliquely, FIG. 10 illustrates that formed in stepwise fashion and FIG. 11 illustrates that formed vertically.

Regardless of these configurations of the separated portions, however, some amount of gas tends to leak out of the high pressure chamber 43 through the separated portions 50 of the seal rings 47*a* and 47*b*.

According to another example of the seal rings of this invention, the construction of the separated portion of each of the seal rings 47*a* and 47*b* is improved for preventing the leakage of the gas therethrough. The embodiment will now be described with reference to FIGS. 12 through 16. In the shown embodiment, for instance,the outer seal ring 47*a* is provided with a separated portion 52 formed into a stepped configuration. More specifically, the seal ring 47*a* is separated in the portion 52 such that two end portions 52*a* and 52*b* of the seal ring 47*a* are overlapped with each other to be slidable in the circumferential direction of the seal ring 47*a*.

According to a characteristic feature of the embodiment, the end portions 52*a* and 52*b* are disposed to be contactable with each other along a plane 53 which is extending radially intermediately of the thickness of the seal ring 47*a*.

More specifically, when it is assumed that the inner radius of the seal ring 47*a* is equal to $R_1$, the outer radius of the same is equal to $R_2$, and the radius of the contact plane 53 is $R_3$, the radius $R_3$ is selected to be $$R_3=(R_1+R_2)/2$$

Furthermore, a central angle $\theta$ formed by a stepped end 53*a* and an end edge 53*c* of the end portion 52*a*, or by a stepped end 53*b* and another end edge 53*d* of the end portion 52*b*, is selected to be less than 10°. In addition, when it is assumed that the radial thickness of the lowermost part, as viewed in FIG. 12, of the seal ring 47*a* is $t_1$ and the radial thickness of the uppermost part of the same is $t_2$, a following relation holds between $t_1$ and $t_2$.

$$t_1 \leqq 0.1\ t_2$$

Although the above described relations have been defined with respect to the outer seal ring 47*a*, it should be noted that the same relations are also established with respect to the inner seal ring 47*b*.

The operation of the scroll compressor according to this invention will now be described.

When the movable scroll member 27 in FIG. 6 is rotated, the compressing space 28 formed between the wraps 26*a* and 27*a* of the stationary scroll member 26 and the movable scroll member 27 is moved along the wraps 26*a* and 27*a* toward the center of the spiroid while the volume of the compressing space 28 is continuously reduced. As a consequence, the gas to be compressed supplied from the gas supplying pipe 30 (FIG. 5) is compressed in the space 28 and delivered from the gas delivering pipe 31. As shown in FIGS. 6 and 7, the movable scroll member 27 is supported by the annular member 40 through the seal rings 47*a* and 47*b* interposed between the two members 27 and 40. On the other hand, the compressed gas fully compressed by the scroll compressor or partly compressed in the compressing space 28 of a compressing stage is supplied through the passage 45 into the high pressure chamber 43. The pressure Pm thus created in the high pressure chamber 43 serves to counteract a downwardly disposed thrusting force created by the internal pressure of the compressing space 28.

When the pressure Pm overcomes the thrusting force, the movable scroll member 27 is shifted upward, thus creating gaps of an equal distance $\Delta l_2$ between the lower surface 34 of the movable scroll member 27 and the upper surface 41 of the annular member 40 as shown in FIG. 7. As a consequence, the pressing forces applied to the seal rings 47*a* and 47*b* are varied and therefore the outer seal ring 47*a* expands radially outwardly by its own resilience to be moved upwardly along the tapered surface of the wall portions 46*a* of the annular member 40. Likewise the inner ring 47*b* shrinks by its own resilience to be moved upwardly along the tapered surface of the wall portion 46*b* of the annular member 40. The upward movements of the seal rings 47*a* and 47*b* permit to seal the gaps S created by the upward displacement of the movable scroll member 27. The seal rings 47*a* and 47*b* are moved downwardly along the tapered walls 46*a* and 46*b* when the movable scroll member 27 is displaced downwardly, and in this manner the gaps S are constantly sealed by the seal rings 47*a* and 47*b* regardless of the movement of the scroll member 27.

Because of the provision of the seal rings 47*a* and 47*b*, sealing of the gaps S provided between the lower surface 34 of the movable scroll member 27 and the upper surface 41 of the annular member 40 can be assured, and the leaked amount of the gas through the gaps can be substantially reduced. The reduction of the leaked gas improves the capacity of the scroll compressor because no recompression of the leaked gas is required, and since the pressure of the high pressure chamber 43 can be maintained at a high value, the downward thrust applied to the movable scroll member 27 can be substantially reduced.

Tapered angle of either of the surfaces 46*a* and 46*b* of the annular member 40 may be selected arbitrarily so far as the aforementioned relation $L_1 > L_2$ is maintained. Furthermore, the surfaces of the seal rings 47*a* and 47*b* slidably contacting with the tapered surfaces 46*a* and 46*b* may be changed into a curved configuration having a radius of curvature without reducing the advantageous features of this invention which are summarized as follows.

(1) Since seal rings having resilience are provided between the lower surface of the movable scroll member and the annular member, and the surface of each seal ring contacting with the tapered surfaces of the annular member is made into a configuration coinciding with the tapered surfaces of the annular member, the seal rings can be moved upwardly and downwardly following the movement of the movable scroll member, and the gaps formed between the lower surface of the movable scroll member and the walls of the annular member can be sealed constantly.

(2) Accordingly, the sealing between the movable scroll member and the annular member can be improved remarkably, and the reduction of the leakage of the pressurized gas from the high pressure chamber and the improvement of the capacity of the scroll compressor can be achieved satisfactorily.

(3) Since the pressure of the high pressure chamber can be maintained at a high level, the downward thrust applied to the movable scroll member can be substantially reduced.

Figure 17:
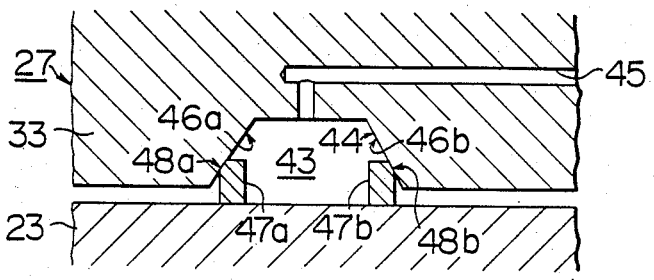
FIG. 17 is a sectional view showing another embodiment of this invention.

FIG. 17 illustrates another embodiment of this invention wherein the high pressure chamber 43 is provided between the planar portion 33 of the movable scroll member 27 and the frame 23. That is, the high pressure chamber 43 is provided in the form of an annular groove 44 provided in the planar portion 33 of the movable scroll member 27. As described hereinbefore in connection with the former embodiment, tapered surfaces 46*a* and 46*b* are formed along the radially outside and inside walls defining the annular groove 44, and outer and inner seal rings 47*a* and 47*b* are provided in the annular groove 44. The outer and inner seal rings 47*a* and 47*b* have tapered surfaces 48*a* and 48*b* at portions where the seal rings 47*a* and 47*b* contact with the tapered surfaces 46*a* and 46*b* of the annular groove 44, respectively. A fluid passage 45 is provided through the planar portion 33 of the movable scroll member 27 for supplying a pressurized gas obtained from the delivery side of the scroll compressor into the high pressure chamber 43. The operation and advantages of this embodiment are quite similar to those described with respect to the previous embodiment of this invention shown in FIGS. 6 and 7, and further description thereof is omitted for avoiding redundancy.

What is claimed is:

1. A scroll compressor including a casing, a frame provided in the casing, a motor and a compressor assembly mounted on opposite sides of said frame, said compressor assembly having a stationary scroll member and a movable scroll member respectively having spiral wraps engaging with each other so that the movable scroll member is driven by said motor eccentrically around the center of a spiroid spiral of said stationary scroll member, said movable scroll member having a planar portion with a lower surface facing said frame, said stationary scroll member having a peripheral portion secured to said frame, said scroll compressor further comprising:

an annular member formed adjacent said lower surface and separated therefrom by a gap, said annular surface having radially outer and inner walls and a bottom wall for defining an annular high pressure chamber therebetween, said radially outer and inner walls of said annular member having internal surfaces tapered radially outwardly and inwardly from said bottom wall, respectively;

passage means for supplying a portion of a quantity of compressible fluid delivered from said compressor assembly into said high pressure chamber for reducing a thrust force applied to said movable scroll member;

a radially outer resilient seal ring having at least one part of a radially outer surface thereof tapered to be slidable along said tapered outer wall of said high-pressure chamber; and a radially inner resilient sealing ring having at least one part of a radially inner surface thereof tapered to be slidable along said tapered inner wall of said high-pressure chamber, said inner and outer sealing rings sealing said annular high-pressure chamber to said lower surface of said planar portion by closing said gap, each of said outer and inner resilient sealing rings including a sealing surface sealingly contacting said lower surface; and means for maintaining said seal between said annular high-pressure chamber and said lower surface upon a change in the width of said gap, said maintaining means including diameter varying means for resiliently increasing and decreasing the diameters of said inner and outer sealing rings when said sealing rings slide along said respective tapered inner and outer walls.

2. The scroll compressor according to claim 1, wherein said motor is electric.

3. The scroll compressor according to claim 1, wherein said annular member is stationary.

4. The scroll compressor according to claim 1 wherein said annular member is provided separately between said frame and said planar portion of said movable scroll member so as to be secured to said frame and said high pressure chamber is formed in said annular member so as to press said planar portion of said movable scroll member away from said annular member.

5. The scroll compressor according to claim 1, wherein said diameter varying means includes a separated portion formed in each of said seal rings.

6. The scroll compressor according to claim 5, wherein said separated portion comprises a discontinuity in the circumference of each respective seal ring.

7. The scroll compressor according to claim 5 wherein said separate portion is formed between two separate ends of said ring which are slidable with each other circumferentially so as to vary the diameter of the seal ring.

8. The scroll compressor according to claim 7 wherein said two separated ends of said ring are slidable with each other along a circumferential plane which is selected to pass through an intermediate portion of the radial thickness of the seal ring.

* * * * *